US008577256B2

(12) United States Patent
Tsurumi et al.

(10) Patent No.: US 8,577,256 B2
(45) Date of Patent: Nov. 5, 2013

(54) ELECTROSTATIC IMAGE DEVELOPING CARRIER, ELECTROSTATIC IMAGE DEVELOPER, PROCESS CARTRIDGE, IMAGE FORMING METHOD, AND IMAGE FORMING APPARATUS

(75) Inventors: Yosuke Tsurumi, Kanagawa (JP); Rieko Kataoka, Singapore (SG)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/619,014

(22) Filed: Sep. 14, 2012

(65) Prior Publication Data

US 2013/0017482 A1 Jan. 17, 2013

Related U.S. Application Data

(62) Division of application No. 12/556,316, filed on Sep. 9, 2009, now Pat. No. 8,293,445.

(30) Foreign Application Priority Data

Jan. 16, 2009 (JP) ..... 2009-007824

(51) Int. Cl.
*G03G 21/16* (2006.01)
*G03G 9/00* (2006.01)

(52) U.S. Cl.
USPC ..... 399/111; 430/111.3; 430/111.33; 430/111.35; 430/114; 399/252

(58) Field of Classification Search
USPC ..... 430/113.3, 111.33, 111.35, 114; 399/111, 252
See application file for complete search history.

(56) References Cited

U.S. PATENT DOCUMENTS

| | | | |
|---|---|---|---|
| 5,441,839 | A | 8/1995 | Ishikawa et al. |
| 5,595,850 | A | 1/1997 | Honjo et al. |
| 5,766,814 | A | 6/1998 | Baba et al. |
| 5,932,388 | A | 8/1999 | Umeno et al. |
| 2004/0234876 | A1 | 11/2004 | Suzuki et al. |
| 2008/0070150 | A1 | 3/2008 | Kobayashi et al. |
| 2008/0199799 | A1 | 8/2008 | Tsurumi et al. |

FOREIGN PATENT DOCUMENTS

| | | |
|---|---|---|
| CN | 101251726 A | 8/2008 |
| JP | A-06-301245 | 10/1994 |
| JP | A-10-039549 | 2/1998 |
| JP | A-10-142842 | 5/1998 |
| JP | A-2001-154416 | 6/2001 |
| JP | A-2004-264378 | 9/2004 |
| JP | A-2006-072137 | 3/2006 |
| JP | A-2006-267297 | 10/2006 |
| JP | A-2008-096977 | 4/2008 |
| JP | A-2009-003258 | 1/2009 |

OTHER PUBLICATIONS

Japanese Office Action issued in Japanese Patent Application No. 2009-007824 on Oct. 24, 2012 (with English translation).
Korean Office Action issued in Korean Patent Application No. 10-2009-0086324 on Nov. 23, 2012 (with English translation).
Apr. 27, 2012 Office Action issued in Chinese Patent Application No. 200910176010.X (with translation).
Tsurumi et al., U.S. Appl. No. 12/556,316, filed Sep. 9, 2009.

*Primary Examiner* — Thorl Chea
(74) *Attorney, Agent, or Firm* — Oliff & Berridge, PLC

(57) ABSTRACT

An electrostatic image developing carrier includes a ferrite particle that contains magnesium element in an amount of about 3.0 wt % or more and about 10.0 wt % or less and manganese element in an amount of about 0.2 wt % or more and less than about. 1.0 wt %; and a resin layer that covers the ferrite particle.

3 Claims, No Drawings

ELECTROSTATIC IMAGE DEVELOPING CARRIER, ELECTROSTATIC IMAGE DEVELOPER, PROCESS CARTRIDGE, IMAGE FORMING METHOD, AND IMAGE FORMING APPARATUS

CROSS-REFERENCE TO RELATED APPLICATIONS

This application is a division of U.S. patent application Ser. No. 12/556,316, filed on Sep. 9, 2009, based on and claiming priority under 35 USC 119 from Japanese Patent Application No. 2009-007824 filed on Jan. 16, 2009.

BACKGROUND

1. Technical Field

The present invention relates to an electrostatic image developing carrier, an electrostatic image developer, a process cartridge, an image-forming method, and an image-forming apparatus.

2. Related Art

In electrophotography, an image is obtained by charging, forming an electrostatic latent image on an image holding member (a photoreceptor) by an exposure process, developing the latent image with a toner containing a coloring agent, transferring the developed image to a transfer member, and fixing by heating. The developer for such electrophotography can be roughly classified into one-component developer such as a toner comprising a binder resin having dispersed therein a coloring agent for use as a toner alone, and a two-component developer comprising a toner and a carrier. Since the carrier has functions of charging and carrying and high in controllability, the two-component developers are now widely used.

SUMMARY

According to an aspect of the invention, there is provided an electrostatic image developing carrier including a ferrite particle that contains magnesium element in an amount of about 3.0 wt % or more and about 10.0 wt % or less and manganese element in an amount of about 0.2 wt % or more and less than about 1.0 wt %; and a resin layer that covers the ferrite particle.

DETAILED DESCRIPTION

<Electrostatic Image Developing Carrier>

The electrostatic image developing carrier (hereinafter sometimes referred to as simply "carrier" ) according to the exemplary embodiment has ferrite particles and resin layer for covering the ferrite particles, and the content of magnesium element of the ferrite particles is 3.0 wt % or more and 10.0 wt % or less, or about 3.0 wt % or more and about 10.0 wt % or less, and the ochtent of manganese element is 0.2 wt % or more and less than 1.0 wt %, or about 0.2 wt % or more and less than about 1.0 wt %.

Incidentally, in the exemplary embodiment, the description of "from A to B" showing numerical values means "A or more and B or less", that is, the numerical range including the endpoints A and B.

<Ferrite Particles>

The electrical resistance of ferrite particles varies according to the composition and structure thereof. It is known that magnetite ferrite consisting of the composition of iron alone as the metal is low in electrical resistance. This is thought for the reason that electrons are easy to move between $Fe^{3+}$ and $Fe^{2+}$. Ferrites using metal elements other than iron, for example, manganese ferrite and copper-zinc ferrite, are high in electrical resistance. This is presumably for the reason that electron movement between $Fe^{3+}$ and $Fe^{2+}$ is little. This is also the same as in magnesium ferrite.

The present inventors have found that, in the case of magnesium ferrite, it is necessary to increase crystallizability of the ferrite to heighten saturation magnetization, but superexchange action cannot be expected of magnesium in the ferrite and higher crystallizability is necessary, and electronic movement is easy for ferrite having high crystallizability, so that electrical resistance lowers.

On the other hand, the inventors have found electrical resistance also varies according to the structure of ferrite. The greater and more uniform the inside grains, the lower is the electrical resistance. This is presumably due to the fact that the hindrance factors of electronic monument are few.

Accordingly, for increasing electrical resistance, it is thought effective to make the structure in the ferrite uneven and congregations of minute grains. In this case, since a continuous plane of crystal is few and uneven, movement of electrons in the ferrite particle is difficult. In the case of ferrite containing magnesium, the difference in the melting points of iron and magnesium is great, so that the inside structure is liable to be uneven. Accordingly, it becomes possible to make ferrite having high electrical resistance according to manufacturing method of ferrite particles. However, for sufficiently increasing electrical resistance, it is necessary to set up proper temperature gradient and particle size before calcination.

By the combination of these, it becomes possible for ferrite containing magnesium to reconcile high saturation magnetization and high electrical resistance. From the same reason, similar effect can also be obtained by ferrite using lithium, but lithium is highly affinitive with water as compared with magnesium, and the difference in electrical resistances under high temperature high humidity condition and low temperature low humidity condition is large. In the case of ferrite containing magnesium, when takes the above structure, increase in resistance according to the structure is difficultly influenced by the environment, and it is possible to lessen environmental difference of resistance as compared with magnetite and manganese ferrite.

In the exemplary embodiment, the content of magnesium element of ferrite particles is 3.0 wt % or more and 10.0 wt % or less, or about 3.0 wt % or more and about 10.0 wt % or less, and the content of manganese element is 0.2 wt % or more and less than 1.0 wt %, or about 0.2 wt % or more and less than about 1.0 wt %.

When the magnesium content is less than 3 wt %, electron movement between $Fe^{+}$ and $Fe^{2+}$ becomes easy and high resistance is difficultly obtained. While when the content exceeds 10 wt %, it is difficult to increase saturation magnetization.

The content of magnesium is preferably 3 wt % to 8 wt % or about 3 wt % to about 0 wt %, more preferably 4 wt % to 6 wt % or about 4 wt % to about 6 wt %, and still more preferably 4 wt % to 5 wt % or about 4 wt % to about 5 wt %.

In the manufacture of magnesium ferrite, a small amount of manganese is often mixed as a contamination by an impurity of the raw material. Manganese enters into crystal lattices in ferrite and exhibits the characteristics of manganese ferrite. On the other hand, when saturation magnetization is increased, electrical resistance of magnesium ferrite greatly lowers.

For the above reason, it has been difficult to take balance of saturation magnetization and electrical resistance of magnesium ferrite. For reconciling saturation magnetization with electrical resistance of magnesium ferrite, it is necessary to make the constitution of the inside grains uneven and interface of crystals discontinuous. The inventors have found that it is suitable to contain a trace amount of manganese element to take balance of saturation magnetization and electrical resistance of magnesium ferrite, thus the exemplary embodiment has been accomplished.

When the content of the manganese element in ferrite particles is 1.0 wt % or more, control of crystallization becomes difficult (difference in movement of Mn and Mg by temperature), and it is difficult to form a desired structure. Further, when the content of the manganese element is less than 0.2 wt %, crystallization of magnesium ferrite rapidly progresses and control is difficult.

The content of manganese element is preferably 0.3 wt % to 0.8 wt % or about 0.3 wt % to about 0.8 wt %, more preferably 0.3 wt % to 0.6 wt % or about 0.3 wt % to about 0.6 wt %, and still more preferably 0.3 wt % to 0.4 wt % or about 0.3 wt % about 0.4 wt %.

It has been conventionally difficult to reconcile fine line reproduction and image deficiency by carrier splashing under high temperature high humidity environment with a blank area of an image end part under low temperature low humidity environment. It is necessary to increase resistance of carrier to achieve fine line reproducibility and restrain carrier splashing under high temperature high humidity environment. If resistance of carrier is low, the quantity of charge is low and more than enough toner is also liable to be developed for fine line, so that to draw fine line becomes difficult. Further, when resistance of carrier is low, charge of the toner shifts to the carrier and sometimes the carrier is developed. In this case, deficiency such as a blank area occurs in the image. For improving these disadvantages, it is necessary to heighten resistance of the carrier. However, the resistance value under low temperature low humidity is generally higher than the resistance value under high temperature high humidity. If the difference is great, the carrier designed to resistance under high temperature high humidity is to have too high resistance under low temperature low humidity, as a result there is a case where a blank area of an image end part occurs.

A blank area of an image end part is a phenomenon that a part where the density of toner is insufficient is caused at the end part of an image and this is thought to he generated for the following reason. When the toner held by the carrier shifts to an image-holding member photoreceptor) reverse charge of the charge of the toner is accumulated in the carrier. When reverse charge is accumulated in the carrier like this, a part of the toner is attracted by the charge and adhered again to the carrier, as a result a blank area occurs at the end part of the image. The higher the resistance of the carrier, the more difficult is the charge to wear itself out and a blank area is liable to occur. On the other hand, accumulation of reverse charge is difficult to occur in an uneven grain structure and a structure having variation in element as described above, and a blank area of an image end part is difficultly brought about.

Since the carrier according to the exemplary embodiment is small in difference in resistance by environment, it is easy to reconcile fine line reproducibility and the control of image deficiency due to carrier splashing under high temperature high humidity with prevention of a blank area of an image end part under low temperature low humidity environment.

The amounts of manganese element and magnesium element of the ferrite particles of a carrier are measured according to a fluorescence X-ray method.

A measuring method by fluorescence X-ray will be described. As pre-treatment of a sample, ferrite particles are subjected to pressure molding of 10 t, 1 minute with a pressure molding machine, and measured with a fluorescence X-ray measuring apparatus (SRF-1500, manufactured by Shimadzu Corporation), by the measuring condition of tube voltage of 49 KV, tube current of 90 mA, and measuring time of 30 minutes.

Further, as a method of isolation of core particles from carrier, it is sufficient to carbonize the covering resin components of the resin-covered carrier at 200° C. and wash with ion exchange water and elemental analysis is performed with fluorescence X-ray. Alternatively, a method of dissolving or peeling the covering resin in an appropriate organic solvent to remove, it may be used. The contents can be quantitatively measured by making a calibration curve of the element of each of magnesium and manganese.

Ferrite particles for use in the exemplary embodiment are not especially restricted and manufactured, for example, as follows.

Prescribed amounts of iron oxide and magnesium oxide are mixed, pulverized with mixing in a wet ball mill for 25 hours, granulated with a spray drier and dried. The particles are further subjected to temporary calcination in a rotary kiln at 1,050° C. for 7 hours. The thus obtained temporarily calcined product is further ground with the wet ball mill for 5 hours to make average particle size 1 to 2 μm or so and further granulated with the spray drier and dried. Subsequently, temporary calcination is further performed at 1,150° C. for 6 hours with the rotary kiln. The thus-obtained temporarily calcined product is an aggregate of fine particles consisting of congregation of relatively highly crystalline particulates inside. After the temporarily calcined product is ground with the wet ball mill for 2 hours to make the average particle size 5.6 μm, further granulation and drying with the spray drier, calcination in an electric furnace at 900° C. for 12 hours, additional calcination at 1,200° C. for 4 hours, and magnesium ferrite is prepared through subsequent cracking process and classification process.

The temperature and time of temporary calcination and calcination, condition of cracking may be optionally selected.

The content of manganese contained in ferrite core can be adjusted, for example, as follows. Iron oxide raw material hardly containing manganese component can be obtained by dissolving ordinarily refined iron in acid, and further treated with acid. Similarly refined iron hydroxide can also be used as the raw material. By adding calculated amount of manganese oxide or hydroxide to the raw material, ferrite having an objective amount of manganese can be obtained. It is also possible to obtain objective ferrite by reducing the content of manganese from the iron oxide for use in the ferrite. For removing manganese from iron oxide, a method of dissolving the iron oxide in acid, and reducing the ratio of manganese by using a chelating agent having higher sensitivity to manganese is known. There is also a method of dissolving iron oxide acid, increasing pH slowly, and repeating centrifugation in a state of pH 6 or so to recover iron content.

Since iron oxide ($Fe_2O_3$) raw materials sometimes contain manganese as impurity, the calculated values of manganese content calculated from iron oxide, magnesium oxide, and manganese oxide to be added do not necessarily coincide with actual measured values. Accordingly, in the exemplary embodiment, the addition amount of manganese oxide or hydroxide is optionally adjusted so as to reach the manganese content of the exemplary embodiment taking the contamination from iron oxide and the like into account.

The average particle size of ferrite particles is preferably 3 to 10 times the average particle size of the toner particles to be used, more preferably 4 to 8 times, and still more preferably 5 to 7 times. When the average particle size of ferrite particles is in the above range, the number of times of the toner particles to be brought into contact with the surface of toner is made uniform, and difference in charge among toner particles is reduced and so preferred.

Further, the shape factor SF1 of carrier is preferably in the range of 110 or more and 145 or less, or about 110 or more and about 145 or less, and more preferably in the range of 120 or more and 140 or less, or about 120 or more and about 140 or less. When the shape factor is in the above range, the contact of the carrier and the toner is a proper state and the effect of the quantity of charge is further improved.

The shape factor SF1 of carrier particles and the later-described toner particles is a shape factor to show the degree of unevenness of particle surface and computed from the following equation.

$$SF_1 = \frac{(ML)^2}{A} \times \frac{\pi}{4} \times 100$$

In the formula, ML represents the maximum length of a particle, and A represents the projected area of a particle.

SF1 is specifically measured, for example, as follows. An optical micrograph of the carrier scattered on a slide glass is imported into an image analyzer through a video camera, and SF1 is computed of fifty carrier particles and the average value is found.

<Covering Resin>

In the exemplary embodiment, carrier is ferrite covered with a resin. From the viewpoints of prevention of adhesion of spent toner to the carrier and the adjustment of charge, carrier surface is covered with a resin.

Covering resins are not especially restricted and can be optionally selected from known carrier-covering resins, for example, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin including organosiloxane bonds and modified products thereof, fluorine resin, polyester, polycarbonate, phenol resin, epoxy resin, urea resin, urethane resin, melamine resin, etc., are exemplified. These resins may be used by one kind alone, or two or more kinds may be used in combination.

Of these resins, it is preferred to use acrylic resin, styrene resin, polyester resin, hydrocarbon resin, and copolymers of these resins. For the purpose of giving positive chargeability to toners, it is preferred to contain at least one resin selected from the group consisting of (meth)acrylic resin, styrene-(meth)acrylic resin, polyester resin, and silicone resin, and it is particularly preferred to contain silicone resin.

The content of the (meth)acrylic resin, styrene-(meth) acrylic resin, polyester resin, and silicone resin is preferably 50 wt % or more and 100 wt % or less of the covering resin component as the total amount, more preferably 75 wt % or more and 100 wt % or less, and still more preferably 90 wt % or more and 100 wt % or less, and it is especially preferred that the covering resin includes a resin selected from the group consisting of (meth)acrylic resin, styrene-(meth)resin, polyester resin, and silicone resin.

Incidentally, description of "(meth)acryl" in the exemplary embodiment is abbreviating expression of methactyl and acryl.

As the styrene series resins, polymers and copolymers of styrenes, such as styrene, parachlorostyrene, α-methylstyrene, etc., are exemplified.

As the (meth)acrylic resins, polymers and copolymers of α-methylene fatty acid monocarboxylic acids, e.g., methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate, etc., and nitrogen-containing acryls, e.g., dimethylaminoethyl methacrylate, etc., are exemplified.

As the styrene-(meth)acrylic resins, copolymers of the polymerizable monomers shown above in the styrene resins and the polymerizable monomers shown above in the (meth) acrylic resins are exemplified.

These covering resins may be resins (polymers) obtained by polymerization of a monomer substituted with fluorine (a monomer having a fluorine atom). As the specific examples of the polymerizable monomers having a fluorine atom, fluoromethyl(meth)acrylate, difluoromethyl(meth)acrylate, trifluoromethyl(meth)acrylate, tritluoromethylethyl(meth)acrylate, tetrafluoroethylmethyl(meth)acrylate, perfluoropropylethyl(meth)acrylate, perfluorobutylethyl (meth)acrylate, perfluorohexylethyl(meth)acrylate, perfluorooctylethyl(meth)acrylate, perfluorooctylmethyl(meth) acrylate, etc., are exemplified.

In the exemplary embodiment, to use resins as the covering resins is preferred. By the use of the silicone resins, excellent adhesion with ferrite particles can be obtained, and so preferred, which will be described in detail below.

In conventional covered carriers, the thickness of the resin layer covering the core materials is not uniform or the core materials are partially bared, and there are many cases where the thickness of the resin cover layer is very uneven. As a result, falling off of the cover layer from the surface of carriers is generated after long term use of developers, and reduction of resistance of carriers occurs, which often causes hindrances such that splashing of carrier is caused in charge injection, fine line reproducibility is deteriorated, and the difference in resistance becomes large due to the difference in environments.

In the exemplary embodiment, it is possible to take the balance of saturation magnetization and resistance of the carrier core material and make the difference due to environment small by prescribing the content of magnesium element and the content of manganese element of ferrite particles of the core materials, and further, the above objects can be solved by covering the surfaces of ferrite particles with silicone resin.

With respect to adhesion of the cover layers to the core material, falling off of the cover layers can be reduced from electrostatic natures of magnesium ion and silicone resin. In view of these facts, even when the carrier is repeatedly used in a developing apparatus, lowering of performance due to falling off of resin layers is difficult to occur, and even if peeling off is generated, fluctuation in resistance is small and the difference due to environment is also small, splashing of carrier is difficult to occur, and fine line reproducibility can be compatible with inhibition of a blank area of an image end part. Further, from high surface tension of silicone resins, the carrier has an antifouling property, and even when the carrier is repeatedly brought into contact with a toner, the toner hardly adheres to the carrier, so that performance reduction by fouling can also be decreased.

In the exemplary embodiment, silicone resins indicate all of general silicone resins, and straight silicone resins consisting of organosiloxane bonds, silicone resins modified with alkyd, polyester, epoxy, acryl, and urethane are exemplified, but the embodiment is not restricted thereto. From the viewpoint of providing charge, it is preferred to use the above modified silicones.

In the exemplary embodiment, the thickness of resin layer of the carrier is preferably 0.05 μm to 1.5 μm or about 0.05 μm to about 1.5 μm, and more preferably 0.1 μm to 1.0 μm or about 0.1 μm to about 1.0 μm. When the thickness of the resin layer is 0.05 μm or more, uniform cover layers are easily formed and preferred. By uniform covering of the resin layers, shift of the carrier to a photosensitive material by charge injection is controlled. When the thickness of the resin layer is 1.5 μm or less, resistance of the carrier is proper and appearance of strong edge effect can be preferably restrained.

The higher the covering rate of the resin layer to the surface area of the core material (ferrite particles), the less is the bared part of the core material, and the core material is more uniformly covered with the resin layer. That is, the covering rate of the resin layer is the index of uniformity of the resin layer. It is preferred that the resin layer is present on 70% or more, or about 70% or more of the surface area of the core material. When the covering rate of the resin layer is 70% or more, the influence, of environmental charging ability of the core material can be preferably lessened. The covering rate of the resin layer is more preferably 80% to 98% or about 80% to about 98%, still more preferably 85% to 96% or about. 35% to about 96%, and especially preferably 88% to 95% or about as% to about 95%.

The covering rate of the resin layer on the core material. surface can be controlled mainly by the weight ratio of the material constituting the resin layer to the weight of the core material, the rate of dilution of the material in a solvent, and stress of thermal: stirring. The covering rate of the resin layer can be found from the bare amount of the core material (e.g., Fe) according to X-ray photoelectric spectroscopy (ESCA) (JPS-80, manufactured by Nihon Denshi Co., Ltd.).

For the purpose of controlling charging and resistance, resin particles and inorganic particles may be used by dispersion in the covering resin. As the resin particles, e.g., melamine resin particles, urea resin particles, urethane resin particles, and polyester resin particles are exemplified. As the inorganic particles, carbon black particles, titanium oxide particles, silicon oxide particles, metallic fine particles, and metallic oxide particles are exemplified.

As the method of forming the resin cover layer on the surface of the carrier core material (ferrite particles), an immersion method of immersing the powder of the carrier core material in a cover layer-forming solution, a spraying method of spraying a cover layer-forming solution on the surface of the carrier core material, a fluidized bed method of spraying a cover layer forming solution on the surface of the carrier core material while maintaining the carrier core material floating with fluidized air, a kneader coater method of mixing the carrier core material and a cover layer-forming solution in a kneader coater and removing a solvent, and a powder coating method of granulating a cover resin, mixing the granulated powder and the carrier core material in kneader coater at temperature higher than the melting temperature of the cover resin, and cooling to form a cover are exemplified, and of these methods, a kneader coater method and a powder coating method are especially preferably used.

The amount of the resin cover layer formed by these methods is preferably 0.5 wt % or more and 10 wt % or less, or about. 0.5 wt % or more and about 10 wt % or less to the carrier core material (ferrite particles), and more preferably 1.5 wt % or more and 3-5 wt % or less, or about 1.5 wt % or more and about 3.5 wt % or less.

(Electrostatic Image Developer)

In the exemplary embodiment, the electrostatic image developer contains the electrostatic image developing carrier according to the exemplary embodiment and the electrostatic image developing toner (hereinafter also referred to as merely "toner")

The mixing ratio of the toner and the carrier (by weight) is preferably in the range of toner/carrier of 1/100 to 30/100and more preferably in the range of 3/100 to 20/100.

<Electrostatic Image Developing Toner>

The main component of an electrostatic image developing toner (hereinafter also referred to as merely "toner") in a method of visualizing image data via an electrostatic image such as electrophotography is a binder resin. As the binder resins that can be used in the electrostatic latent image developing toner in the exemplary embodiment, ethylene series resins, polyethylene, polypropylene, etc., styrene series resins, e.g., polystyrene, α-polymethylstyrene, etc., (meth) acrylic series resins, e.g., polymethyl methacrylate, polyacrylonitrile, etc., polyamide resin, polycarbonate resin, polyether resin, polyester resin, and copolymer resins of these resins are exemplified, and from the viewpoints of charging stability and developing durability in using as the electrostatic latent image developing toners, styrene series resins, copolymer resins of (meth)acrylic series resins and styrene-(meth) acrylic series resins, and polyester resins are preferably used.

Binder resins are manufactured by various methods, and styrene series resins and copolymer resins of (meth)acrylic series resins and styrene-(meth)acrylic series resins can be manufactured by radical polymerization, in that case, compounds having a thiol component as the chain transfer agent can be used.

In the exemplary embodiment, the electrostatic latent image developing toner at least contains a binder resin and a coloring agent, and if necessary, other components, such as wax and the like.

[Manufacturing Method of Toner]

In the exemplary embodiment, the manufacturing method of the electrostatic latent image developing toner is not especially restricted, and a kneading and grinding method, an emulsion polymerization aggregation method and a suspension polymerization method can be used, and an emulsion aggregation method is especially preferred.

In the emulsion aggregation method, resin particle dispersion having dispersed therein a binder resin having a particle size of preferably 1 μm or less, and a coloring agent dispersion having dispersed therein a coloring agent are mixed. Uniformly dispersed binder resin particles and coloring agent are aggregated to toner particle size in an aggregation process, and the aggregated particles through the aggregation process are heated at a temperature higher than the glass transition temperature of the resin particles and fused to form toner particles in a fusion process.

In the exemplary embodiment, it is more preferred for the electrostatic image developing toner to be manufactured by a manufacturing process including a dispersion process of dispersing at least a binder resin particles and coloring agent particles in an aqueous medium, an aggregation process of aggregating the dispersed particles with metal ions, an additional aggregation process of aggregating the particles by additionally adding binder resin particles alone, and a thermal fusion process of thermally fusing the aggregated particles.

In the aggregation process, the particles of resin particle dispersion, coloring agent dispersion and, if necessary, releasing agent dispersion, mixed to each other are aggregated and form aggregated particles.

The aggregated particles are formed by hetero-aggregation and the like, and for the purpose of the stabilization, control of particle size and particle size distribution of the aggregated particles, ionic surfactants having different polarity from the aggregated particles, and compounds having monovalent or higher charge such as metal salts, may be added. Aggregating agents are described later.

In the fusion process, the resin particles in the aggregated particles are fused by a temperature higher than the glass transition temperature thereof and the aggregated particles change from amorphous to spherical. After that, the aggregate is separated from the aqueous medium and, if necessary, washed and dried to form toner particles.

[Particle Size Distribution, etc. of Toner]

The volume average particle size of the toner is preferably 2 μm to 10 μm or about 2 μm to about 10 μm, more preferably 3 μm to 8 μm or about 3 μm to about 8 μm, and still more preferably 4 μm to 6 μm or about 4 μm to about 6 μm.

The particle size distribution of the toner is preferably narrow. More specifically, the ratio of 16% particle size ($D_{16p}$) and 84% particle size ($D_{84p}$) from the small particle size side in terms of number particle size of the toner and shown as square root ($GSD_p$), i.e., $GSD_p$ represented by $$GSD_p=[(D_{84p})/(D_{16p})]^{0.5}$$

is preferably 1.23 or less, or about 1.23 or less, and more preferably 1.21 or so.

When the volume average particle size and $GSD_p$ are in the above ranges, transferability in the transfer process in the image-forming method is good, and so preferred.

The shape factor SF1 of the toner is preferably in the range of 110 to 140 or about 110 to about 140, and more preferably 120 to 140 or about 120 to about 140. It is well known that in the transfer process in electrophotographic process, the more spherical the toner, the easier is it transferred, and in the cleaning process, the more amorphous the toner, the easier is it to clean. The shape factor SF1 of the toner is measured according to the similar method of the shape factor SF1 of the carrier.

[Binder Resin]

As the binder resins that can be used for electrostatic latent image developing toner in electrostatic latent image developing toner, ethylene series resins, e.g., polyethylene, polypropylene, etc., styrene series resins, e.g., polystyrene, poly(α-methylstyrene), etc., (meth)acrylic series resins, e.g., polymethyl(meth)acrylate, polyacrylonitrile, etc., polyamide resin, polycarbonate resin, polyether resin, polyester resin, and copolymer resins of these resins are exemplified, and from the viewpoints of charging stability and developing durability in using as the electrostatic latent image developing toners, styrene series resins, copolymer resins of (meth) acrylic series resins and styrene-(meth)acrylic series resins, and polyester resins are preferably used.

As the polymerizable monomers for use in the polyester resins, the polymerizable monomer components described in Kobunshi Data Handbook, Kiso-Hen (Polymer Data Handbook, Fundamentals), compiled by The Society of Polymer Science, published by Baifu-kan, for example, conventionally known divalent or trivalent or higher carboxylic acids and divalent or trivalent or higher alcohols are exemplified. As the specific examples of these polymerizable monomer components, as the divalent dicarboxylic acids, dibasic acids, e.g., succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, mesaconic acid, etc., and anhydrides and lower alkyl esters of these acids; and aliphatic unsaturated dicarboxylic acids, e.g., maleic acid, fumaric acid, itaconic acid, citraconic acid, etc., are exemplified. As the trivalent or higher carboxylic acids, 1,2,4-benzenetricarboxylic acid, 1,2,5-benzene-tricarboxylic acid, 1,2,4-naphthalenetricarboxylic acid, and anhydrides and lower alkyl esters of these acids. These polymerizable monomer components may be used alone, or two or more in combination.

As divalent alcohols, e.g., bisphenol A, hydrogenated bisphenol A, ethylene oxide or (and) propylene oxide adduct of bisphenol A, 1,4-cyclohexanediol, 1,4-cyclohexanedimethanol, ethylene glycol, diethylehe glycol, propylene glycol, dipropylene glycol, 1,3-butanediol, 1,4-butanediol, 1,5-pentanediol, 1,6-hexanediol, 1,9-nonanediol, neopentyl glycol, etc., are exemplified. As the trivalent or higher alcohols, e.g., glycerin, trimethylolethane, trimethylolpropane, pentaerythritol are exemplified. These may be used by one kind alone, or two or more kinds may be used in combination, if necessary, for the purpose of adjustment of acid value and hydroxyl group value, monovalent acid such as acetic acid, enzoic acid, etc., monovalent alcohol such as cyclohexanol, benzyl alcohol, etc., may be used.

As the polymerizable monomers constituting the styrene series resins, (meth)acrylic series reins and copolymer resins thereof, as styrene series monomers, alkyl-substituted styrene having an alkyl chain, e.g., styrene, α-methylstyrene, vinyl naphthalene, 2-methylstyrene, 3-methylstyrene, 4-methylstyrene, 2-ethylstyrene, 3-ethylstyrene, 4-ethylstyrene, etc.; halogen-substituted styrene, e.g., 2-chlorostyrene, 3-chlorosytrene, 4-chlorostyrene, etc.; and fluorine-substituted styrene, e.g., 4-fluorostyrene, 2,5-difluorostyrene, etc.; as (meth) acrylic acid series monomers, e.g., (meth)acrylic acid, n-methyl(meth)acrylate, n-ethyl(meth)acrylate, n-propyl (meth)acrylate, n-butyl(meth)acrylate, n-pentyl(meth)acrylate, n-hexyl(meth)acrylate, n-heptyl(meth)acrylate, n-octyl (meth)acrylate, n-decyl(meth)acrylate, n-dodecyl(meth) acrylate, n-lauryl(meth)acrylate, n-tetradecyl(meth)acrylate, n-hexadecyl(meth)acrylate, n-octadecyl(meth)acrylate, isopropyl(meth)acrylate, isobutyl(meth)acrylate, tert-butyl (meth)acrylate, isopentyl(meth)acrylate, amyl(meth)acrylate, neopentyl(meth)acrylate, isohexyl(meth)acrylate, isoheptyl(meth)acrylate, isooctyl(meth)acrylate, 2-ethylhexyl(meth)acrylate, phenyl(meth)acrylate, biphenyl(meth) acrylate, diphenylmethyl(meth)acrylate, tert-butylphenyl (meth)acrylate, terphenyl(meth)acrylate, cyclohexyl(meth) acrylate, t-butylcyclohexyl(meth)acrylate, dimethylaminoethyl(meth)acrylate, diethylaminoethyl (meth)acrylate, methoxyethyl(meth)acrylate, 2-hydroxyethyl(meth)acrylate, β-carboxyethyl(meth)acrylate, (meth) acrylonitrile, (meth)acrylamide, etc, are exemplified.

When a carboxyl group is introduced into the above styrene series resins, (meth)acrylic series resins and copolymer resins thereof, the carboxyl group can be introduced by the copolymerization with a copolymerizable monomer having a carboxyl group.

As the specific examples of such copolymermerizable monomer, acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butencdc acid, ferulic acid, fumaric acid, brassidic: acid, 2- (2-furyl) acrylic acid, bromocinnamic acid, bromofumaric acid, bromomaleic acid, benzylidenemalonic benzoylacrylic acid, 4-pentenoic acid, maleic acid, mesaconic acid, methacrylic acid, methylcinnamic acid, methoxycinnamic acid, etc., are exemplified, and from the easiness of polymer-forming reaction, acrylic acid, metbacrylic acid, maleic acid, cinnamic acid, and fumaric acid are preferred.

In the exemplary embodiment, at the time of polymerization of the binder resin for the toner, a chain transfer agent can be used. The chain transfer agent is not particularly restricted, and compounds having a thiol component can be used. Specifically, alkyl mercaptans, e.g., hexyl mercaptan, heptyl mercaptan, octyl mercaptan, nonyl mercaptan, decyl mercaptan, dodecyl mercaptan, etc., are preferred. They are preferred in the point of capable of providing toners narrow in molecular weight distribution and excellent in preservation stability at high temperature.

If necessary, a crosslinking agent may be added to the binder resin in the exemplary embodiment.

The specific examples of the crosslinking agents include aromatic polyvinyl compounds, e.g., divinyibenzene, divihylnaphthalene, etc.; polyvinyl esters or aromatic polyvalent carboxylic acids, e.g., divinyl phthalate, divinyl isophthalate, divinyl terephthalate, divinyl homophthalate, diyinyl/triyinyl trimesate, divinyl naphthalenedicarboxylate, divinyl biphenylcarboxylate etc.; divinyl esters of nitrogen-containing aromatic compounds, e.g., divinyl pyridinedicarboxylate, etc.; vinyl esters of unsaturated heterocyclic compound carboxylic acid, e.g. vinyl pyromucate vinyl furancarboxylate, vinyl pyrrole-2-carboxylate, vinyl thiophenecarboxylate, etc.; (meth) acrylic esters of straight chain polyhydric alcohols, e.g., butanediol methacrylate, hexnediol acrylate, octanediol methacrylate, decanediol acrylate, dodecanediol methacrylate, etc.; (meth)acrylic esters of branched substituted polyhydric alcohols, e.g., neopentyl glycol dimethacrylate, 2-hydroxy-1,3-diacryloxypropahe, etc.; polyethylene glycol di(meth)acrylates, polypropylene polyethylene glycol di(meth)acrviates; and polyvinyl esters of polyvalent carboxylic acid, e.g., divinyl succinate, divinyl fumarate, vinyl/divinyl maleate, divinyl diglycolate, vinyl/divinyl itaconate, divinyl acetonedicarboxylate, divinyl giutarate, divinyl 3,3'-thiodipropionate, divinylltrivinyi trans-aconitate, divinyl adipate, diviryl pimelate, divinyl suberate, divinyl azelate, divinyl sebacate, divinyl dodecane diacid ester, divinyl brassylate, etc.

In the exemplary embodiment, these crosslinking agents may be used by one kind alone, or two or more kinds may be used in combination. Of the above crosslinking agents, it is preferred in the exemplary embodiment to use (meth)acrylic esters of straight chain polyhydric alcohols, e.g. butahediol methacrylate, hexnediol acrylate, octahediol methacrylate, deoanediol acrviate, dodecanediol methacrylate, etc.; (meth) acrylic esters of branched substituted polyhydric alcohols, e.g., neopentyl glycol dimethacrylate, 2-hydroxy-1,3-diacryloxypropane, etc.; polyethylene glycol di(meth)acrviates, polypropylene: polyethylene: glycol. di(meth)acrylates, etc.

A preferred content of the crosslinking agent is preferably in the range of 0.05 to 5 wt % of the total weight of the polymerizable monomers, and more preferably in the range of 0.1 to 1.0 wt %.

Of the resins for use in the toners in the exemplary embodiment, resins that can be manufactured by radical polymerization of polymerizable monomers can be polymerized by using a radical polymerization initiator.

The radical polymerization initiator is not especially restricted. Specifically, peroxides, e.g., hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenyl acetate tert-butylhydroperoxide, tert-butyl performate, tert-butyl peracetate, tert-butyl perbenzoate, tert-butyl perphenylacetate, tert-butyl permethoxyacetate, tert-butyl per-N-(3-toluyl)carbamate, etc Azo compounds, e.g., 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobasisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethyl-phenylazo-2-methylmalonodinitrile, 2-(4 -bromophenylazo)-2-allymalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propyl-butyronitrile, 1,1'-azobis-1-chlorophenylethane, 1,1'-azobis-1-cyclohenanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenylmethane, phenyl azotriphenylmethane, 4-nitrophenylazotriphenylmethane, 1,1'-azobis-1,2-diphenyl-ethane, poly(bisphenol A-4,4'-azobis-4-cyanopentanoate), poly(tetraethylene glycol-2,2'-azobisisobutyrate), etc.; 1,4-bis(pentaethylene)-2-tetrazene, 1,4-dimethoxycarbonyl-1,4-diphenyl-2-tetrazene, etc., are exemplified.

In the manufacture of the toner in the exemplary embodiment, a surfactant can be used for the purpose of stabilization at the time of dispersion in the suspension polymerization, and dispersion stabilization of the resin particle dispersion, coloring agent dispersion, and releasing agent dispersion in the emulsion polymerization aggregation method.

As the surfactants, anionic surfactants, such as sulfuric esters, sulfonic esters, phosphoric esters, soaps, etc.; cationic surfactants, such as amine salt type, quaternary ammonium salt type, etc.; and nonionic surfactants, such as polyethylene glycol, alkylphenol ethylene oxide adducts, polyhydric alcohols, etc., are exemplified. Of these surfactants, ionic surfactants are preferred, and anionic surfactants and cationic surfactants are more preferred.

Anionic surfactants are generally high in dispersing force and excellent in dispersing resin particles and coloring agents, therefore, it is advantageous to use anionic surfactants as the surfactants to disperse releasing agents in the toner in the exemplary embodiment.

It is preferred that the nonionic surfactants are used in combination with the anionic surfactant or cationic surfactant. These surfactants may be used by one kind alone, or two or more kinds may be used in combination.

As the specific examples of the anionic surfactants, fatty acid soaps, e.g., potassium laurate, sodium oleate, sodium castor oil, etc.; sulfates, e.g., octyl sulfate, lauryl sulfate, lauryl ether sulfate, nonyl phenyl ether sulfate, etc.; sodium alkylnaphthalene sulfonates, e.g., laurl sulfonate, dodecylbenzene sulfonate, triisopropylnaphthalene sulfonate, dibutyinaphthalene sulfonate, etc.; sulfonates, e.g., naphthalene sulfonate-formalin condensation product, monooctyl sulfosuccinate, dioctyl sulfosuccinate, launic acid amide sulfonate, oleic acid amide sulfonate, etc.; phosphates, e.g., lauryl phosphate, isopropyl phosphate, nonyl phenyl ether phosphate, etc.; dialkyl sulfosuccinate, e.g., dioctyl sodium sulfosuccinate, etc.; and sulfosuccinate, e.g., lauryl disodium sulfosuccinate, etc., are exemplified.

As the specific examples of the cationic surfactants, amine salts, e.g., laurylamine hydrochloride, stearylamine hydrochloride, oleylamine acetate, stearylamine acetate, stearylarainopropylamine acetate, and quaternary ammonium salts, e.g., lauryl trimethylammonium chloride, dilauryl dimethylammonium chloride, distearyl dimethylammonium chloride, distearyl dimethylammonium chloride, lauryl dihydroxyethylmethylammonium chloride, oleylbispolyoxyethylene methylammonium chloride, lauroylaminopropyl dimethylethylammonium ethosulfate, lauroylaminopropyl dimethylhydroxyethylammonium perchlorate, alkylbenzene dimethylammonium chloride, alkyl trimethylammonium chloride, etc., are exemplified.

As the specific examples of the nonionic surfactants, alkyl ethers, e.g., polyoxyethylene octyl ether, polyoxyethylene lauryl ether, polyoxyethylene stearyl ether, polyoxyethylene oleyl ether, etc.; alkyl phenyl ethers, e.g., polyoxyethylene octyl phenyl ether, polyoxvethylene nonyl phenyl ether, etc.; alkyl esters, e.g., polyoxyethylene laurate, pcayoxyethylene stearate, polyoxyethylene oleate, etc.; alkylamines, e.g., polyoxyethylene lauryl amino ether, polyoxyethylene stearyl amino ether, polyoxyethylene oleyl amino ether, polyoxyethylene soybean amino ether, polyoxyethylene beef tallow amino ether, etc.; alkylamides, e.g., polyoxyethylene lauric acid amide, polyoxvethylene stearic acid amide, polyoxyethylene oleic acid amide, etc.; vegetable oil ethers, e.g., polyoxyethylene castor oil ether, polyoxyethylene rape oil ether, etc.; alkanolamides, e.g., lauric acid diethanolamide, stearic acid diethanolamide, oleic acid diethanolamide, etc.; and sorbitan ester ethers, e.g., polyoxyethylene sorbitan monolaurate, polyoxyethylene sorbitan monopalmitate, polyoxyethylene sorbitan monostearate, polyoxyethylene sorbitan monooleate, etc., are exemplified.

The content of the surfactant in each dispersion is the range of not hindering the exemplary embodiment, and generally a small amount. Specifically, the range is preferably 0.01 to 3 wt % or so, and more preferably 0.05 to 2 wt %, and still more preferably 0.1. to 1 wt % or so. When the content is in the above range, each dispersion of resin particle dispersion, coloring agent dispersion and releasing agent dispersion is stable and not aggregated, there is not difference in stability among particles at the time of aggregation, specific particles are not freed, and the effect of the exemplary embodiment is sufficiently obtained. Suspension polymerization toner dispersion having a large particle size is generally stable even with a small use amount of surfactant.

As the dispersion stabilizers for use in suspension polymerization, hardly water-soluble and hydrophilic inorganic powder can be used. As the inorganic powders that can be used, silica, alumina, titania, calcium carbonate, magnesium carbonate, tricalcium phosphate (hydroxyl apatite), clay, diatomaceous earth and bentonite are exemplified. Of these powders, calcium carbonate and tricalciura phosphate are preferred in the points of easiness of size formation of particles and easiness of removal.

Aqueous polymers that are solids at ordinary temperature can also be used Specifically, cellulose compounds such as carboxymethyl cellulose and hydroxypropyl cellulose, polyvinyl alcohol, gelatin, starch and gum arabic can be used.

The toner in the exemplary embodiment may contain a charge controlling agent.

Known charge controlling agents can be used, and azo series metal complex compounds, metal complex compounds of salicylic acid, and resin type charge controlling agents having a polar group can be used. It is preferred to use hardly water-soluble materials when a toner is manufactured by a wet manufacturing method in the points of the control of ion strength (%) and the reduction of fouling by waste water. The toner in the exemplary embodiment may be either a magnetic toner containing a magnetic material inside or a nonmagnetic toner not containing a magnetic material.

When an aggregation coalescence method is used in the manufacture of the toner in the exemplary embodiment, particles can be manufactured by causing aggregation by a pH change in the aggregation process. At the same time, for stably and rapidly achieving aggregation of particles and obtaining aggregated particles having narrower particle size distribution, an aggregating agent may be used.

As the aggregating agent, compounds having monovalent or higher charge are preferably used. The specific examples include water-soluble, surfactants, e.g., the above ionic surfactants and nonionic surfactants, acids, e.g., hydrochloric acid, sulfuric acid, nitric acid, acetic acid, oxalic acid, etc., metal salts of inorganic acids, e.g., magnesium chloride, sodium chloride, aluminum sulfate, calcium sulfate, ammonium sulfate, aluminum nitrate, silver nitrate, copper sulfate, sodium carbonate, etc., metal salt of aliphatic acids and aromatic acids, e.g., sodium acetate, potassium formate, sodium oxalate, sodium phthalate, potassium salicylate, etc., metal salts of phenols, e.g., sodium phenolate, metal salts of amino acids, and inorganic acid salts of aliphatic and aromatic amines, e.g., triethanolamine hydrochloride and aniline hydrochloride.

When stability of aggregated particles, stability of aggregating agents against heat and aging, removal at washing time are considered, metal salts of inorganic acids are preferred as the aggregating agents in the point of performance and from use. Specifically, magnesium chloride, sodium chloride, aluminum sulfate, calcium sulfate, aluminum nitrate, silver nitrate, copper sulfate, and sodium carbonate are exemplified. It is also preferred to use aluminum polychloride.

The addition amount of the aggregating agent varies according to the valence of charge, but the amount is preferably small, and in the case of monovalent, the amount is preferably 3 wt % or less, or about 3 wt % or less, in the case of divalent, 1 wt % or less, or about 1 wt % or less, and in the case of trivalent, 0.5 wt % or less, or about 0.5 wt % or less, respectively. Since the amount of the aggregating agent is preferably the smaller, it is preferred to use compounds having higher valence.

[Coloring Agent for Toner]

The coloring agents for use in the exemplary embodiment are not particularly limited and known coloring agents are exemplified, and they can be optionally selected according to the purpose. The coloring agents may be used alone, or two or more kinds of the coloring agents of the similar series may be used as mixture. Further, the coloring agents of two or more kinds of different series may be used as mixture. The coloring agents may be subjected to surface treatment.

As the specific: examples of the coloring agents to be used, black, blue, yellow, orange, red, violet, green and white coloring agents are exemplified as shown below.

As black pigments, organic and inorganic coloring agents such as carbon black, Aniline Black, activated carbon, nonmagnetic ferrite, and magnetite are exemplified.

As blue pigments, organic and inorganic coloring agents such as Berlin Blue, cobalt blue, alkali blue lake, Victoria Blue Lake, Fast Sky Blue, Indanthrene Blue BC, Ultramarine Blue, Phthalocyanine Blue, and Phthalocyanine Green are exemplified.

As yellow pigments, organic and inorganic coloring agents such as chrome yellow, zinc chrome, yellow iron oxide, cadmium yellow, chrome yellow, Fast Yellow, Fast Yellow 5G, Fast Yellow 5GX, Fast Yellow 10G, Benzidine Yellow C, Benzidine Yellow CR, indanthrene yellow, Quinoline Yellow, and Permanent Yellow NCG are exemplified.

As orange pigments, organic and inorganic coloring agents such as red Chrome yellow, molybdenum orange, Permanent Orange GTR, Pyrazolone Orange, Vulcan Orange, Benzidine Orange G Indanthrene Brilliant Orange RK, and Indanthrene Brilliant. Orange GR are exemplified.

As red pigments, organic and inorganic coloring agents such as iron oxide red, cadmium red, red Lead mercury Sulfide, Watchung Red, Permanent Red 4R, Lithol Red Brilliant Carmine 3B, Brilliant Carmine 6B, Du Pont Oil Red, Pyrazolone Red, Rhodamine B Lake, Lake Red C, Rose Bengal, EbSine Red, and Alizarin Lake are exemplified.

As violet pigments, organic and inorganic coloring agents such as manganese violet, Fast Violet B, and Methyl Violet Lake are exemplified.

As green pigments, chromium oxide, chrome green, Pigment Green B, Malachite Green Lake, and Final Yellow Green are exemplified.

As white pigments, Chinese white, titanium oxide, antimony white, and zinc sulfide are exemplified.

As extender pigments, baryta powder, barium carbonate, clay, silica, white carbon, talc and alumina white are exemplified.

[Dispersing Method of Coloring Agent]

The coloring agent in the toner of the exemplary embodiment can be dispersed in a binder resin by known methods. If the toner is manufactured by a kneading and grinding method, the coloring agent may be used as it is, or master batch of kneading the coloring agent with a resin at the time of kneading after being dispersed in the resin in high concentration may be used, or flashing of dispersing in the resin in the state of a wet cake before drying after synthesis of the coloring agent may be used.

The coloring agent can be used as it is in the manufacture of a toner by a suspension polymerization method. In the suspension polymerization method, the coloring agent can be dispersed in granulated particles by dissolving or dispersing the coloring agent having been dispersed in the resin in a polymerizable monomer.

When the toner is manufactured by an aggregation coalescence method, coloring agent dispersion can be granulated in toner particles by dispersing the coloring agent with a dispersant such as a surfactant in an aqueous medium by mechanical impact to prepare coloring agent dispersion, and aggregating the coloring agent dispersion with resin particles and granulating to the toner particle size.

Coloring agent dispersion can be prepared by mechanical impact, specifically with media type disperser, e.g., a rotating shearing type homogenizer, a ball mill, a sand mill, an attritor, and a high pressure opposed impinging type disperser. The coloring agent can be dispersed in an aqueous medium with a homogenizer by using a surfactant having polarity.

For ensuring color development at the time of fixation, the coloring agent is preferably used in the range of 4 to 15 wt % to total weight of the toner solids content, and more preferably in the range of 4 to 10 wt %. However, when magnetic substance not containing iron is used as a black coloring agent, the use amount is preferably in the range of 12 to 48 wt %, and more preferably in the range of 15 to 40 wt %. By optionally selecting the kinds of the coloring agents, a toner of each color of a yellow toner, a magenta toner a cyan toner a black toner, a white toner, a green toner, etc.

[Releasing Agent]

The toner for use in the exemplary embodiment may contain a releasing agent, if necessary. A releasing agent is generally used for the purpose of improving the releasing property. The specific examples of the releasing agents include low molecular weight polyolefins, e.g., polyethylene, polypropylene, polybutene, etc.; silicones having a softening temperature by heating; fatty acid amides, e.g., oleic acid amide, erucic acid amide, ricinoleic acid amide, stearic acid amide, etc.; vegetable waxes, carnauba wax, rice wax, candelilla wax, Japan wax, lojoba oil, etc.; animal waxes, e.g., bees wax, etc.; mineral and petroleum waxes, e.g., montan wax, ozokerite, ceresine, paraffin wax, microcrystalline wax, Fischer-Tropsch wax, etc.; and ester waxes, acid ester, montanic ester, carboxylic ester, etc. These releasing agents may be used by one kind alone, or two or more kinds may be used in combination in the exemplary embodiment.

The addition amount of these releasing agents is preferably 1 to 20 wt % to total weight of the toner particles, and more preferably 5 to 15 wt %. When the addition amount is in the above range, the effect of addition of the releasing agent can be revealed and iron compound is uniformly dispersed in the toner. Since toner particles are not broken in the developing unit, the releasing agent is not spent by the carrier and charge is not liable to lower.

[Internal Additives]

The toner for use in the exemplary embodiment may contain internal additives in the toner. The internal additives are generally used for the purpose of controlling the viscoelasticity of a fixed image. As the specific examples of internal additives, inorganic fine particles such as silica, titania, etc., and organic particles such as polymethyl methacrylate are exemplified, and these particles may be surface-treated for the purpose of heightening the dispersibility. They may be used alone, or two or more kinds of internal additives may be used in combination.

[External Additives]

The toner for use in the exemplary embodiment may be treated by the addition of external additives such as a fluidizing agent and a charging controlling agent. As the external additives, known materials can be used, such as inorganic particles, e.g., silica surface-treated with a silane coupling agent, etc., titanium oxide, alumina, cerium oxide, carbon black, etc.; polymer particles, e.g., polycarbonate, polymethyl methacrylate, silicone resins, etc.; amine metal salts, salicylic acid metal complexes, etc. These external additives may be used alone, or two or more kinds may be used in combination.

[Image-Forming Method and Image-Forming Apparatus]

The image-forming method in the exemplary embodiment is not especially restricted so long as it is a method using the electrostatic image developer containing the carrier of the exemplary embodiment, but preferably the method has at least the following processes: (a) a charging process of charging an image holding member, (b) an exposure process (a latent image-forming process) of forming an electrostatic latent image on the surface of the image holding member, (c) a developing process of developing the electrostatic latent image formed on the surface of the image holding member with an electrostatic image developer to form a toner image, (d) a transfer process of transferring the toner image formed on the surface of the image holding member to the surface of a transfer-receiving member, and (e) a fixing process of fixing the toner image.

The image-forming apparatus in the exemplary embodiment is not especially restricted so long as it is an apparatus using the electrostatic image developer containing the carrier at the exemplary embodiment, but preferably the apparatus has an image holding member, a charging unit of charging the image holding member, an exposure unit process of exposing the charged image holding member and forming an electrostatic latent image on the surface of the image holding member, a developing unit of developing the electrostatic latent image with an electrostatic image developer to form a toner image, a transfer unit of transferring the toner image to a transfer-receiving member, and a fixing unit of fixing the toner image.

As the above processes and units, conventional processes and units used in image-forming methods and image-forming apparatus can be used. Further, in the exemplary embodiment, the transfer-receiving member is a final recording medium, and when an intermediate transfer-receiving member is used, the toner image formed on the surface of the electrostatic image holding member is once transferred to the intermediate transfer-receiving member and finally transferred to the transfer-receiving member, and the toner image transferred to the surface of the transfer-receiving member is fixed on the surface of the transfer-receiving member.

Further, the image-forming method may have processes other than the above-described processes, for example, a cleaning process for cleaning the surface of the image holding member, and the image-forming apparatus may include a cleaning unit for the surface of the transfer-receiving member.

When an electrophotographic photoreceptor is used as the image holding member, image formation is performed as follows. The surface of the electrophotographic photoreceptor is evenly charged with a Corotron charger, a contact charger, and the like, and then the photoreceptor is exposed and an electrostatic image is formed. Subsequently, a developing roll having formed a developer layer on the surface is brought into contact or comes close, to the photoreceptor and the toner particles are adhered to the electrostatic image to form a toner image on the electrophotographic photoreceptor. The formed toner image is transferred to a transfer-receiving member, e.g., paper, by means of a Corotron charger. Further, the toner image transferred to the surface of the recording medium is fixed with a fixing unit, and the image is formed on the recording medium.

As the electrophotographic photoreceptor, inorganic photoreceptors such as amorphous silicon and selenium, and organic photoreceptors using polysilane and phthalocyanine as a charge-generating material and a charge-transporting material can be used. Amorphous silicon photoreceptors are especially preferred for their long duration of life.

(Process Cartridge)

A process cartridge of the exemplary embodiment is preferably a process cartridge equipped with at least one unit selected from the group consisting of an image holding member, a charging unit for charging the surface of the image holding member, a developing unit for developing an electrostatic latent image with a developer containing a carrier to form a toner image, and a cleaning unit for removing the toner remaining on the surface of the image holding member, and accommodating at least the electrostatic image developer of the exemplary embodiment.

Further, the process cartridge in the exemplary embodiment is preferably attachable to and detachable from the image-forming apparatus.

Further, the process cartridge may include other members such as a destaticizing unit and the like, if necessary.

Process cartridge may adopt known structures, for example, JP-A-2008-7094.89 and JP-A-2008-23736 can be referred to.

EXAMPLE

The exemplary embodiment will be described in more detail with reference to examples, but the exemplary embodiment is by no means restricted to the following examples.

(Coating Solution 1)

| | |
|---|---|
| Styrene-methyl methacrylate (79/21, weight average molecular weight: 80,000) | 30 weight parts |
| Carbon black VXC72 (manufactured by Cabot Corporation) | 4 weight parts |
| Toluene | 250 weight parts |
| Isopropyl alcohol | 50 weight parts |

The above components and glass beads (particle size: 1 mill, the same amount with toluene) are put in a sand mill (manufactured by Kansai Paint Co., Ltd.) and stirred at a rotary speed of 1,200 rpm for 30 minutes to prepare coating solution 1 having a solid content of 10%.

(Coating Solution 2)

| | |
|---|---|
| Silicone resin solution (solids content: 23 wt %, manufactured by Toray Dow Corning Silicone Corporation) | 113 weight parts |
| Carbon black (VXC 72, manufactured By Cabot) | 4 weight parts |
| Toluene | 183 weight parts |

The above components and glass beads (particle size: 1 mm, the same amount with toluene) are put in a sand mill (manufactured by Kansai Paint Co., Ltd.) and stirred at a rotary speed of 1,200 rpm for 30 minutes to prepare coating solution 2 having a solid content of 10%.

(Coating Solution 3)

| | |
|---|---|
| Polyester resin (weight average molecular weight: 50,000, bisphenol A-EO adduct/Terephthalic acid/hexanediol: 10/8/2) | 30 weight parts |
| Carbon black (VXC 72, manufactured By Cabot) | 4 weight parts |
| Toluene | 250 weight parts |
| Isopropyl alcohol | 50 weight parts |

The above components and glass beads (particle, size: 1 mm, the same amount with toluene) are put in a sand mill (manufactured by Kansai Paint Co., Ltd.) and stirred at a rotary speed of 1,200 rpm for 30 minutes to prepare coating solution 3 having a solid content of 10%.

(Coloring Agent Particle Dispersion 1)

| | |
|---|---|
| Cyan pigment: Copper Phthalocyanine B15: 3 (manufactured by Dainichiseika Color & Chemicals Mgf. Co., Ltd.) | 50 weight parts |
| Anionic surfactant (Neogen SC, manufactured by Dai-ichi Kogyo Seiyaku Co., Ltd.) | 5 weight parts |
| Ion exchange water | 200 weight parts |

The above components are mixed, and dispersed with ULTRA-TURRAX (manufactured by IKA) for 5 minutes, and further 10 minutes with an ultrasonic wave bath to obtain coloring agent particle dispersion 1 having a solids content of 21%.

The volume average particle size measured with a particle size distribution measuring instrument (LA-700, manufactured by Horiba, Ltd.) is 160 nm.

(Releasing Agent Particle Dispersion 1)

| | |
|---|---|
| Paraffin wax (HNP-9, manufactured by Nippon Seiro Co., Ltd,) | 19 weight parts |
| Anionic surfactant (Neogen SC, manufactured, by Dai-ichi Kogyo Seiyaku Co., Ltd.) | 1 weight part |
| Ion exchange water | 80 weight parts |

The above components are mixed in a heat resisting vessel, the temperature is raised to 90° C. and stirring is carried out for 30 minutes. In the next place, the melted solution is flown to a Gaulin homogenizer from the bottom part of the vessel. After circling operation of three passage-equivalent under pressure of 5 MPa, pressure is increased to 35 MPa and circling operation of three passage-equivalent is further performed. The thus obtained emulsified liquid is cooled to 40° C. or lower in the heat resisting vessel to obtain releasing agent particle dispersion 1. The volume average particle size measured with a particle size distribution measuring instrument (LA-700, manufactured by Horiba, Ltd.) is 240 nm.

(Resin Particle Dispersion 1)

| | |
|---|---|
| (Oil layer) | |
| Styrene (manufactured by Wako Pure Chemical Industries) | 30 weight parts |
| n-Butyl acrylate (manufactured by Wako Pure Chemical Industries) | 10 weight parts |
| β-Carboxyethyl acrylate (manufactured by Rhodia Nikka) | 1.3 weight parts |
| Dodecanethiol | 0.4 weight parts |
| (Aqueous layer 1) | |
| Ion exchange water | 17 weight parts |
| Anionic surfactant (Dowfax manufactured by The Dow Chemical Company) | 0.4 weight parts |
| (Aqueous layer 2) | |
| Ion exchange water | 40 weight parts |
| Anionic surfactant (Dowfax manufactured by The Dow Chemical Company) | 0.05 weight parts |
| Ammonium peroxodisulfate (manufactured by Wako Pure Chemical industries) | 0.4 weight parts |

The components of the above oil layer and the components of aqueous layer 1 are put in a flask, stirred and mixed to prepare monomer emulsified dispersion. The components of aqueous Layer 2 are put in the reaction vessel, the inside is sufficiently substituted with nitrogen, and the reaction system is heated in an oil bath to reach the temperature of the inside of the reaction system of 75° C. with stirring. The above monomer emulsified dispersion is gradually dripped into the reaction vessel over 3 hours, and emulsion polymerization is performed. After termination of dripping, polymerization is further continued at 75° C., and polymerization is terminated after 3 hours to obtain resin particle dispersion 1.

(Toner 1)

| | |
|---|---|
| Resin particle dispersion 1 | 150 weight parts |
| Coloring agent particle 1 | 30 weight parts |

-continued

| | |
|---|---|
| Dispersion 1 | 40 weight parts |
| Releasing agent particle Dispersion 1 | 0.4 weight parts |
| Polyalumimun chloride | |

The above components are sufficiently mixed and dispersed with ULTRA-TURRAX (manufactured by TKA) in a stainless steel flask, and the mixture is heated to 48° C. in a heating oil bath with stirring the flask. After maintaining at 48° C. for a 80 minutes, 70 weight parts of the above resin particle dispersion 1 is gently added thereto additionally.

After that, the pH in the system is adjusted to 6.0 with a sodium hydroxide aqueous solution in concentration of 0.5 mol/liter, and the stainless steel flask is sealed. The seal of stirring axis is magnetically sealed and the system is heated to 97° C., with continuing stirring, and maintained for 3 hours.

After termination of reaction, the system is cooled at temperature descending rate of 1° C./min, and solid-liquid separation is performed by Nutsche suction filtration. The filtered product is redispersed with ion exchange water at 40° C., stirred at 300 rpm for 15 minutes, and washed. The washing operation is repeated 5 times, and solid-liquid separation is performed by Nutsche suction filtration with No. 5A filter paper. After that, vacuum drying is continued for 12 hours to obtain toner mother particles.

The volume average particle size of the mother particles is 5.5 μm, $GSD_p$ is 1.21 and SF1 is 124.

Silica ($SiO_2$) fine particles having a primary average particle size of 40 nm and subjected to surface hydrophobitization treatment with hexamethyldisilazane (hereinafter sometimes abbreviated to "HMDS") and metatitanic acid compound fine particles, which is a reaction product of metatitanic acid and isobutyltrimethoxysilane, having a primary average particle size of 20 nm are added to the mother particles so that each covering rate on the surface of the toner mother particles is 40%, and mixed with a Henschel mixer to prepare toner 1.

(Ferrite Particles 1)

| | |
|---|---|
| $Fe(OH)_3$ | 1,000 parts |
| $MnO_2$ | 5 parts |
| $Mg(OH)_2$ | 95 parts |

The above components are mixed, and mixing and pulverizing are performed with a wet ball mill for 25 hours, granulated and dried by a spray drier, followed by temporary calcination 1 in a rotary kiln at 1,050° C. for 7 hours. The obtained temporary calcination 1 product is crashed with a wet ball mill for 5 hours to make the average particle size 1.2 μm. Temporary calcination 1 product is further granulated and dried with the spray drier, and then temporary calcination 2 is performed with the rotary kiln at 1,150° C. for 6 hours. The obtained temporary calcination 2 product is crushed with the wet ball mill for 2 hours to make the average particle size 5.6 μm, and after further granulated and dried with the spray drier, subjected to calcination in an electric furnace, at 900° C. for 12 hours, and additional calcination at 1,200° C. for 4 hours. Ferrite particles 1 having a particle size of 36 μm are prepared through a cracking process and a classification process.

(Ferrite Particles 2)

Ferrite particles 2 having a particle size of 36 μm are prepared in the same manner as in the preparation of ferrite particles 1 except for changing the amount of $MnO_2$ to 4 parts.

(Ferrite Particles 3)

Ferrite particles 3 having a particle size of 36 μm are prepared in the same manner as in the preparation of ferrite particles 1 except for changing the amount of $MnO_2$ to 10 parts.

(Ferrite Particles 4)

Ferrite particles 4 having a particle size of 36 μm are prepared in the same manner as in the preparation of ferrite particles 1 except for changing the amount of $MnO_2$ to 4 parts and the amount of $Mg(OH)_2$ to 55 parts.

(Ferrite Particles 5)

Ferrite particles 5 having a particle size of 36 μm are prepared in the same mariner as in the preparation of ferrite particles 1 except for changing the amount of $MnO_2$ to 4 parts and the amount of $Mg(OH)_2$ to 220 parts.

(Ferrite Particles 6)

Ferrite particles 6 having a particle size of 36 μm are prepared in the same manner as in the preparation of ferrite particles 1 except for using 1,000 parts of $F_2O_3$ in place of $Fe(OH)_3$, changing the amount of $Mg(OH)_2$ to 48 parts and excluding $MnO_2$.

(Ferrite Particles 7)

Ferrite particles 7 having a particle size of 36 μm are prepared in the same manner as in the preparation of ferrite particles 1 except for using 1,000 parts of $Fe_2O_3$ in place of $Fe(OH)_3$, changing the amount of $Mg(OH)_2$ to 320 parts and excluding $MnO_2$.

(Ferrite Particles 8)

Ferrite particles 8 having a particle size of 36 μm are prepared in the same mariner as in the preparation of ferrite particles 1 except for excluding $MnO_2$.

(Ferrite Particles 9)

Ferrite particles 9 having a particle size of 36 μm are prepared in the same manner as in the preparation of ferrite particles 1 except for using 1,000 parts of in place of $Fe(OH)_3$, changing the amount of $MnO_2$ to 20 parts and the amount of $Mg(OH)_2$ to 100 parts.

(Carrier 1)

Ferrite particles 1 (2,000 weight parts) are put in a vacuum deaerating type kneader, further 400 weight parts of coating solution 1 is added, and mixed with stirring at 60° C. for 20 minutes under reduced pressure to −200 mmHg. The temperature is raised to 90° C., pressure is reduced to −720 mmHg and the mixture is stirred for 30 minutes, dried, and coated particles are obtained. The particles are filtered through a filter having a pore diameter of 75 μm to obtain carrier 1.

The coating components of the obtained carrier are carbonized at 200° C., washed with ion exchange water, and subjected to elemental analysis with a fluorescent X-ray. The calibration curves of magnesium and manganese are made and the contents are shown in Table 1 below.

(Carrier 2)

Carrier 2 is obtained in the same Manner except for changing ferrite particles 1 to ferrite particles 2. The contents of magnesium and manganese in the obtained carrier are shown in Table 1.

(Carrier 3)

Carrier 3 obtained in the same manner except for changing ferrite particles 1 to ferrite particles 3. The contents of magnesium and manganese in the obtained carrier are shown in Table 1.

(Carrier 4)

Carrier 4 is obtained in the Same manner except for changing ferrite particles 1 to ferrite particles 4. The contents of magnesium and manganese in the obtained carrier are shown in Table. 1.

(Carrier 5)

Carrier 5 is obtained in the same manner except for changing ferrite particles 1 to ferrite particles 5. The contents of magnesium and manganese in the obtained carrier are shown in Table 1.

(Carrier 6)

Carrier 6 is obtained in the same manner except for changing ferrite particles 1 to ferrite particles 6. The contents of magnesium and manganese in the obtained carrier are shown in Table 1.

(Carrier 7)

Carrier 7 is obtained in the same Manner except for changing ferrite particles 1 to ferrite particles 7. The contents of magnesium and manganese in the obtained carrier are shown in Table 1.

(Carrier 8)

Carrier 8 is obtained in these. Same manner except for changing ferrite particles 1 to ferrite particles 8. The contents of magnesium and manganese in the obtained carrier are shown in Table. 1.

(Carrier 9)

Carrier 9 is obtained in the same manner except for changing ferrite particles 1 to ferrite particles 9. The contents of magnesium and manganese in the obtained carrier are shown in Table. 1.

(Carrier 10)

Carrier 10 is obtained in the same manner except for changing ferrite particles 1 to ferrite particles 2.

(Carrier 11)

Carrier 11 is obtained in the same manner except for changing ferrite particles 1 to ferrite particles 2.

TABLE 1

| | Ferrite Particles | | | | Content in Ferrite Particles (wt %) | | Particle Size | Shape Factor |
|---|---|---|---|---|---|---|---|---|
| | $Fe(OH)_3$ | $MnO_2$ Mixing Amount (weight parts) | $Mg(OH)_2$ | $Fe_2O_3$ | Mg | Mg | (μm) | SF1 |
| Carrier 1 | 1,000 | 5 | 95 | — | 0.4 | 5 | 36 | 130 |
| Carrier 2 | 1,000 | 4 | 95 | — | 0.3 | 5 | 36 | 129 |
| Carrier 3 | 1,000 | 10 | 95 | — | 0.8 | 5 | 36 | 133 |
| Carrier 4 | 1,000 | 4 | 55 | — | 0.3 | 3 | 36 | 128 |
| Carrier 5 | 1,000 | 4 | 220 | — | 0.3 | 10 | 36 | 126 |
| Carrier 6 | — | 0 | 48 | 1,000 | 0.2 | 2 | 36 | 135 |
| Carrier 7 | — | 0 | 320 | 1,000 | 0.2 | 12 | 36 | 128 |
| Carrier 8 | 1,000 | 0 | 95 | — | 0 | 5 | 36 | 129 |

TABLE 1-continued

| | Ferrite Particles | | | | Content in Ferrite Particles (wt %) | | Particle Size | Shape Factor |
|---|---|---|---|---|---|---|---|---|
| | $Fe(OH)_3$ | $MnO_2$ Mixing Amount (weight parts) | $Mg(OH)_2$ | $Fe_2O_3$ | Mg | Mg | (μm) | SF1 |
| Carrier 9 | — | 20 | 100 | 1,000 | 1.5 | 4 | 36 | 135 |
| Carrier 10 | 1,000 | 4 | 95 | — | 0.3 | 5 | 36 | 128 |
| Carrier 11 | 1,000 | 4 | 95 | — | 0.3 | 5 | 36 | 129 |

The following evaluations are performed by using carriers 1 to 11.

<Confirmation of Effect>

Printing is performed with a modified apparatus of Docu Centre Color 400 (a product of Fuji Xerox Co., Ltd.) in the environment of 30° C., 83% RH on the following condition.

(1) A developer having the weight ratio of the toner 12 to carrier 100 is prepared.

(2) Half-tone output of every 200 sheet of the whole surface is performed on the condition that the loading amount of the toner is 0.1 mg/cm$^2$ on paper of size A4.

(3) The character of "Xerox" is printed on 5 sheets by MS Gothic style and the sizes of 4 mm×10 mm and 3 mm×7.5 mm, and defacing of character is confirmed.

In the next place, printing is performed with a modified apparatus of Docu Centre Color 400 (a product of Fuji Xerox Co., Ltd.) in the environment of 10C, 12% RH on the following condition.

(1) A developer of the weight ratio 6 of the above toner is prepared.

(2) An image of a square image of 5 mm×5 mm in the printing direction and the loading amount of the toner of 0.3 mg/cm$^2$ is repeated 10 times is outputted.

<Evaluation>

[Reproducibility of Character]

A: Defacing is not observed at all.

B: Defacing is not observed in the character of 4 mm×4 mm but the character of 3 mm×3 mm is a little defaced.

C: Bath characters are defaced.

[High Temperature High Humidity Image Deficiency]

A: Deficiency is not observed.

B: A small blank area is observed but no problem on a practicable level.

C: Deficiency is observed.

[Low Temperature to Humidity Image Effect]

A: Deficiency is not observed.

B: A small blank area is observed but no problem on a practicable

C: A blank area of the image end part is observed and not practicable level.

The results of evaluations are shown in Table 2 below.

TABLE 2

| | Toner | Carrier | High Temperature High Humidity: Reproducibility of Character | High Temperature High Humidity: Deficiency of Image | Low Temperature Low Humidity: Deficiency of Image |
|---|---|---|---|---|---|
| Example 1 | Toner 1 | Carrier 1 | A | A | A |
| Example 2 | Toner 1 | Carrier 2 | A | B | A |
| Example 3 | Toner 1 | Carrier 3 | A | A | A |

TABLE 2-continued

| | Toner | Carrier | High Temperature High Humidity: Reproducibility of Character | High Temperature High Humidity: Deficiency of Image | Low Temperature Low Humidity: Deficiency of Image |
|---|---|---|---|---|---|
| Example 4 | Toner 1 | Carrier 4 | A | B | B |
| Example 5 | Toner 1 | Carrier 5 | B | B | A |
| Comparative Example 1 | Toner 1 | Carrier 6 | B | C | C |
| Comparative Example 2 | Toner 1 | Carrier 7 | C | B | C |
| Comparative Example 3 | Toner 1 | Carrier 8 | C | C | C |
| Comparative Example 4 | Toner 1 | Carrier 9 | C | C | C |
| Example 6 | Toner 1 | Carrier 10 | A | A | A |
| Example 7 | Toner 1 | Carrier 11 | A | B | A |

What is claimed is:

1. A process cartridge attachable to and detachable from an image-forming apparatus, comprising:

an electrostatic image developer; and at least one selected from the group consisting of an image holding member, a charging unit that charges a surface of an image holding member, a developing unit that develops a latent image formed on a surface of an image holding member with the electrostatic image developer to form a toner image, and a cleaning unit that removes a toner remaining on the surface of the image holding member, wherein the electrostatic image developer comprises an electrostatic image developing carrier comprising a ferrite particle that contains metal elements, the metal elements consisting of iron, magnesium, and manganese, the ferrite particle containing the magnesium element in an amount of from 3.0 wt % to 10.0 wt % and the manganese element in an amount of from 0.2 wt % to 1.0 wt %, a resin layer that covers the ferrite particle, and a toner.

2. An image-forming method comprising:

charging an image holding member;

exposing the charged image holding member to form an electrostatic latent image on a surface of the image holding member;

developing the electrostatic latent image formed on the surface of the image holding member with an electrostatic image developer to form a toner image;

transferring the toner image formed on the surface of the image holding member to a surface of a transfer-receiving member; and fixing the toner image, wherein the electrostatic image developer comprises an electrostatic image developing carrier comprising a ferrite particle that contains metal elements, the metal elements consisting of iron, magnesium, and manganese, the ferrite particle containing the magnesium element in an amount of from 3.0 wt % to 10.0 wt % and the manganese element in an amount of from 0.2 wt % to 1.0 wt %, a resin layer that covers the ferrite particle, and a toner.

3. An image-forming apparatus comprising:

an electrostatic image developer;

an image holding member;

a charging unit that charges the image holding member;

an exposure unit that exposes the charged image holding member to form an electrostatic latent image on the image holding member;

a developing unit that develops the electrostatic latent image with the electrostatic image developer to form a toner image;

a transfer unit that transfers the toner image from the image holding member to a transfer-receiving member; and a fixing unit that fixes the toner image, wherein the electrostatic image developer comprises an electrostatic image developing carrier comprising a ferrite particle that contains metal elements, the metal elements consisting of iron, magnesium, and manganese, the ferrite particle containing the magnesium element in an amount of from 3.0 wt % to 10.0 wt % and the manganese element in an amount of from 0.2 wt % to 1.0 wt %, a resin layer that covers the ferrite particle, and a toner.

* * * * *